United States Patent [19]

Harvill

[11] 4,335,836

[45] Jun. 22, 1982

[54] BEVERAGE DISPENSER HAVING AN IMPROVED LEVEL CONTROL FOR A LIQUID HEAT EXCHANGE MEDIUM

[75] Inventor: William A. Harvill, Stone Mountain, Ga.

[73] Assignee: The Cornelius Company, Anoka, Minn.

[21] Appl. No.: 126,931

[22] Filed: Mar. 3, 1980

[51] Int. Cl.[3] ..... B67D 1/16

[52] U.S. Cl. ..... 222/108

[58] Field of Search ..... 222/64, 108; 126/383, 126/384, 359; 137/577

[56] References Cited

U.S. PATENT DOCUMENTS

| | | | |
|---|---|---|---|
| 1,058,033 | 4/1982 | Case | 137/577 |
| 1,859,774 | 5/1932 | Hunt | 137/577 X |
| 2,721,065 | 10/1955 | Ingram | 137/577 X |

*Primary Examiner*—Stanley H. Tollberg
*Attorney, Agent, or Firm*—Henry C. Kovar

[57] ABSTRACT

A beverage dispenser having a beverage ingredient cooling tank for containing a liquid heat exchange medium such as ice water has an improved level control and drain for the tank having a first medium conduit with an inverted U-shape with an upper apex of the U-shape conduit being substantially at the desired level of medium in the tank, an open anti-syphon port to ambient from the conduit at a level above the apex, an outlet above and emptying into a drip tray under a dispensing nozzle, and a second medium conduit comprising a flexible tube fluidly connected to the bottom of the tank and to an inlet of the first conduit; excess liquid in the tank escapes out of the first conduit into the drip tray, and the second conduit is disconnectible from the first conduit for draining the tank into the drip tray.

4 Claims, 3 Drawing Figures

BEVERAGE DISPENSER HAVING AN IMPROVED LEVEL CONTROL FOR A LIQUID HEAT EXCHANGE MEDIUM

BACKGROUND OF THE INVENTION

1. FIELD OF THE INVENTION

This invention pertains to a beverage dispenser having an improved level control for controlling the level of a liquid heat exchange medium within a cooling tank of the dispenser.

2. THE PRIOR ART

Beverage dispensers with ice bath cooling tanks have been popular for many years. A typical ice bath cooling tank includes a tank which is filled with water, a refrigeration evaporator to freeze an ice bank in the water within the tank, serpentine cooling coils through which beverage ingredients such as water and syrup are propelled, an agitator for circulating the water heat exchange medium between the coils, and some type of device for establishing the level of water and ice within the tank; provisions are also usually made for some device to drain the tank of its water.

There are several problems inherent with liquid medium heat exchange. The water level must be maintained. If the level becomes too low, the agitator motors cavitate and gurgle, the quantity of ice will be lessened, and cooling efficiency is reduced. If the water level becomes too high, water will creep into the agitator motor and effect bearing seizure or burn out, water will be thrown out of the tank, and the entire dispenser will become wet. The natural tendency of these dispensers is for the quantity of water within the refrigerated tank to increase because of condensation of humidity from ambient air. Contamination of bath water is also a problem. Over a period of time, organic growths tend to appear in the tank much like that grown on a river bottom. There are two ways to combat this, either toxic chemical additives or periodic changes of the bath water.

One of the prior structures used to control bath water level is a notch in the upper wall of the tank. Excess water merely runs over the side. The disadvantages are the water runs into the components of the dispenser, the water tends to get into insulation around the tank, it's a mess, corrosion of components adjacent to the notch and disposal of the water run-off. This level control structure also requires a discrete drain structure.

A stand pipe within the tank is another prior structure. There are two types of stand pipe; one is welded in place permanently in the tank and the second structure has a removable pipe.

The welded-in pipe usually projects through the bottom, has a drain hose attached to its bottom and the top of the pipe is at the desired water level. Problems with this structure include freeze-ups, the pipe interferes with circulation of water, the pipe is fragile and easily damaged as refrigeration and/or product cooling coils are removed or installed, it's difficult to manufacture and treat for corrosion resistance, a discrete drain device is required and ambient air tends to draft upwardly in the pipe and effect increased condensation in the tank. This pipe usually needs to be connected into a drain line or else the overflow is run into a base pan and evaporated to atmosphere.

The removable pipe structure has a coupling fitting welded into the tank bottom with the stand pipe having a threaded bottom and wrenchable top. The pipe is removed for draining the tank. The problems are essentially the same as for the welded pipe. In addition, the threads tend to freeze and the pipe twists or breaks during removal, the pipe may not be tightened and leak through the coupling, and the coupling will break out of the tank.

Discrete drain structures used include a petcock valve or a piece of tubing leading out of the bottom tank. The tubing piece usually has a removable plug in its loose end and lies inside and on the bottom of the dispenser.

The foregoing prior art does operate, but is inconvenient and difficult to use. Dispenser owners do not change bath water often enough. Filling of the dispensers is usually done with premeasured volumetric quantities, e.g. 7.5 liters or some such measurement, and contamination, corrosion and loss of heat transfer capability are persistent problems.

OBJECTS OF THE INVENTION

It is an object of the present invention to provide a beverage dispenser having an improved level control for a liquid heat exchange medium tank within the dispenser.

It is an object of the present invention to provide a beverage dispenser having an improved single structure for both level control in and drainage of a liquid heat exchange medium tank within the dispenser.

It is an object of the present invention to improve the sanitation of a beverage dispenser with an improved liquid heat exchange medium level control and drain construction.

It is an object of the present invention to provide a beverage dispenser having a coolant bath level control and drain which both empty into a common and single drip tray underneath a dispensing nozzle.

Many other advantages, features and additional objects of the present invention will become apparent to those versed in the art upon making reference to the enabling detailed description and accompanying drawings in which the preferred embodiment incorporating the principles of the present invention is set forth and shown by way of illustrative example.

SUMMARY OF THE INVENTION

In accordance with the principles of the present invention, a beverage dispenser having a tank for liquid heat exchange medium has an improved medium level control comprising a medium conduit having an inverted U-shape, the conduit being positioned with respect to the tank so that an apex of the conduit is substantially at the height of a desired water level within the tank, an outlet for discharge of the medium, an inlet fluidly connected to the tank at a level below the apex, and an open anti-syphon port at a level above the apex.

DESCRIPTION OF THE PREFERRED EMBODIMENT

Figure 1:
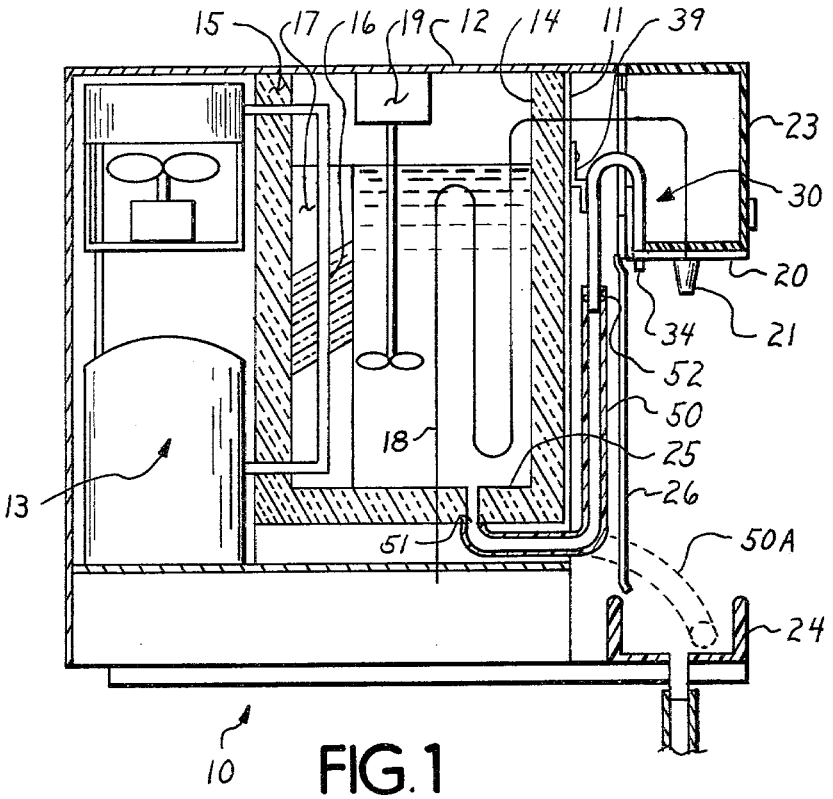
FIG. 1 is an elevation view in cross section of the preferred embodiment of a beverage dispenser in accordance with the principles of the present invention.

The present invention is particularly useful when embodied in a beverage dispenser of the type shown in FIG. 1 and generally indicated by the numeral 10.

The dispenser 10 has frame 11 upon which is mounted a cabinet 12. Within the dispenser 10 is a refrigeration system 13 including the usual compressor, condenser and condenser fan. A beverage ingredient cooling tank 14 is open to atmospheric pressure and is within the dispenser 10 and has an insulated wall 15 within which is a refrigeration evaporator 16 which freezes a quantity of ice 17. A product cooling coil 18, one of which is shown, is provided for each discrete beverage ingredient. There may be several of the cooling coils 18, one for water and one for each syrup. The tank 14 is filled with water and an agitator motor 19 circulates the water between the cooling coil 18 and ice 17 for heat exchange between beverage ingredient within the cooling coil 18 and the ice 17. Water is the most common liquid heat exchange medium used in the tank 14, but other liquids such as ethylene glycol mixtures, eutectic solutions and the like are sometimes used.

On the front of the dispenser 10 is a generally horizontal nozzle plate 20 extending across the width of the dispenser 10. The plate 20 serves as a mount for a dispensing nozzle 21 which is connected to the cooling coil 18, and for a lock 22 which is engagable with a hingedly mounted and openable hood 23. Underneath the nozzle 21 is a drip tray 24 which is directly under the nozzle 21 and which is at a level below the level of a bottom 25 of the tank 14. An easily removable splash panel 26 is clipped to the front of the cabinet 12 and spans between the nozzle plate 20 and the drip tray 24.

Figure 2:
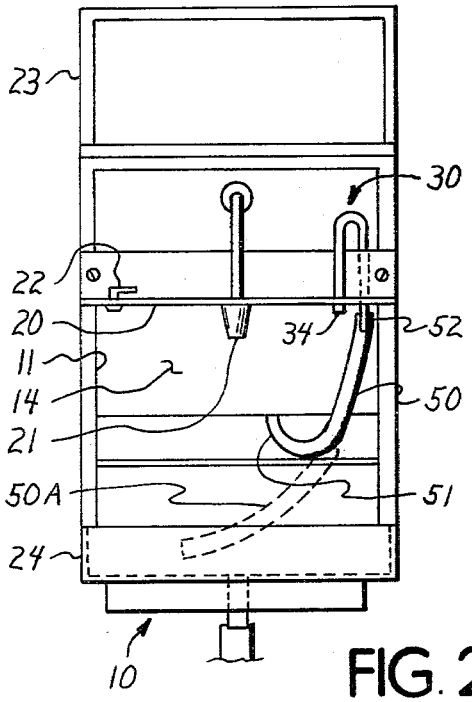
FIG. 2 is a front elevational view of the beverage dispenser of FIG. 1.
Figure 3:
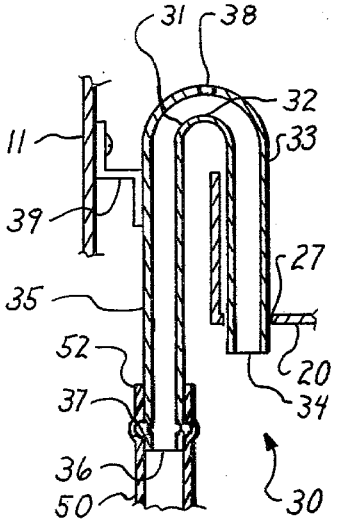
FIG. 3 is an elevational detail view of the level control of the beverage dispenser of FIG. 1.

An important feature in the dispenser 10 is an improved level control, generally indicated by the numeral 30, for controlling the level of a liquid heat exchange medium within the tank 14. The level control 30 is outside of the tank 14 in an easily accessible location and is in unobstructed fluid communication with the inside of the tank 14. The level control has an inverted U-shaped conduit 31 for the liquid heat exchange medium. The medium conduit 31 is positioned with respect to the tank 14 so that an apex 32 of the conduit 31 is substantially at the height of a desired medium level within the tank 14. The apex 32 structurally forms the highest part of the conduit 31 over which medium must flow to be discharged from the tank 14. The conduit 31 has an outlet leg 33 extending downward from the apex 32, and an outlet 34 which together with the leg 33 is spaced laterally from the dispensing nozzle 21 a distance which is greater than the diameter of beverage cups normally filled under the nozzle. The outlet 34 is registered with an aperture 27 in the nozzle plate 20. The outlet leg 33 is of sufficient length so that it projects through the plate aperture 27 and the outlet 34 is slightly below the plate 20. The conduit 31 also has an inlet leg 35 which is of longer length than the outlet leg 33, and which is to the rear of and which extends substantially below the nozzle plate 20. At the bottom of the inlet leg 35 is an inlet 36 having an exterior expanded bead 37 forming a major outer diameter of the inlet 36. An open anti-syphon port 38 opens the interior of the conduit 31 to ambient for flow of air either in or out of the conduit 31. The anti-syphon port 38 is at a level above the apex 32 and preferably is directly above the apex 32 and at the highest point of the conduit 31. The conduit 31 is a rigid structure of 5/16 inch (8 mm) inside diameter stainless steel tubing. The anti-syphon port is an aperture drilled through the tubing and has a preferred diameter of 0.062 inch (1.6 mm). The conduit 31 is mounted to the dispenser with a bracket 39 which is preferably secured to the frame 11, enabling removal of the nozzle plate 20 or the tank 14 without removal of the conduit 31 from the dispenser 10. The anti-syphon port 38 is covered and protected from contaminants by the normally closed hood 23, which is shown in the opened position in FIG. 2, with the splash panel 26 removed, for giving unobstructed and easy access to the level control without removal of the cabinet 12 or moving of the dispenser 10.

The conduit 31 is fluidly connected to the tank at a level below the level of the apex 31. The preferred structure for connecting the conduit 31, hereinafter referred to as the first conduit, is a second conduit 50. The second conduit 50 is a flexible length of elastomeric tubing having an inlet end 51 fluidly connected to bottom 25 of the tank 14. By the bottom 25 of the tank 14, is meant substantially the lowest level of fluid storage volume. The second conduit 50 has an outlet end 52 normally fluidly connected to the inlet 36 of the first conduit 31. The second conduit 50 has an inside diameter slightly smaller than the major outside diameter of the first conduit inlet 36, specifically the outside diameter of the bead 37, and the second conduit outlet end 52 is frictionally retained to the first conduit inlet 36 at a level below the level of the nozzle plate 20 where easy access and visual exposure are provided upon removal of the splash panel 26. The connection of the second conduit 50 to the first conduit 30 is at a level nearer to the apex 32 or desired medium level than to the level of the tank bottom 25. This minimizes the static pressure of the medium upon the connection at the second conduit inlet 36, and minimizes the leakage problem. The drip tray 24 is common to both of the dispensing nozzle 21 and level control outlet 34, and is below the level of the tank bottom 25. The second conduit outlet end 52 is manually disconnectible from the first conduit 31 and the second conduit 50 is of a length enabling its outlet end 52 to be placed within the drip tray 24 for draining of the tank 14 via the drip tray 24 and its drain, as shown in dotted lines as 50A.

The improved beverage dispenser level control 30 and drain structure by the second conduit 50 in combination with the level control 30 is a substantial improvement over the prior art. Filling of the tank 14 is made easier; volumetric measuring is not required. The person filling merely fills until water begins to run out of the level control 30 and then terminates filling. There is no freeze-up problem because the level control 30 is outside of the tank 14 and at ambient temperature. There is no drafting of ambient air into the tank 14. The cost of the device is very moderate. Draining of the tank 14 has been simplified and more frequent changing of liquid in the tank, and improved sanitation, is anticipated. The entire device is very easily accessible and does not require removal of the cabinet 12.

These advantages, usages and many other usages will be found and realized by those versed in the art, and although various minor modifications may be suggested and employed by those who are versed in the art, be it known that we wish to embody within the scope of the patent granted hereon all such embodiments as reasonably come within the scope of our contribution to the art.

I claim as my invention:

1. In a beverage dispenser having a beverage ingredient cooling tank for containing a liquid heat exchange medium, a dispensing nozzle, a generally horizontal nozzle plate which is mounted to the dispenser and which supports the nozzle, and a common drip tray under both of the nozzle and the first conduit outlet, an improved medium level control and drain comprising a. a first medium conduit having an inverted U-shape, said conduit being positioned with respect to the tank so that an apex of the conduit is substantially at the height of a desired medium level within the tank, said conduit having an inlet and an outlet;

b. a second medium conduit comprising a flexible length of tubing having an inlet end fluidly connected to a bottom of the tank and an outlet end normally fluidly connected to the inlet of the first conduit, the outlet of said second conduit being disconnectible from the first conduit and lowerable to a position at or below the level of the tank bottom for draining of the tank; and in which c. said first conduit has an outlet leg spaced laterally from the nozzle and in registry with an aperture in the nozzle plate, and an inlet leg of longer length than the outlet leg, said inlet leg extending substantially below and being rearward of the nozzle plate with the connection of the second conduit to the first conduit inlet being at a level below the level of the nozzle plate.

2. In a beverage dispenser having a beverage ingredient cooling tank for containing a liquid heat exchange medium, means within the tank and submersible in the medium for cooling beverage, a drip tray at a level below the level of a bottom of the tank, and a beverage dispensing nozzle positioned above the drip tray and connected to the cooling means, an improved combination medium level control and medium drain comprising:

a. a first medium conduit having an inverted U-shape, said conduit being outside of and fixedly positioned with respect to the tank and having 1. an apex substantially at the height of a desired medium level within the tank,
2. an inlet which is outside of the tank,
3. an outlet which is outside of the tank and which is horizontally spaced from the nozzle and is fixed to the dispenser in a position directly above the drip tray, and
4. an anti-syphon port at a level above the level of the apex; and b. a second medium conduit comprising a length of flexible tubing outside of the tank, said second conduit having an inlet end fluidly connected to a bottom of the tank and an outlet end normally fluidly connected to the first conduit inlet, the conduit outlet being disconnectable from the first conduit and lowerable to a position in the drip tray and below the tank bottom for selective and complete draining of the tank into the same said drip tray into which the nozzle and first conduit outlet empty so that beverage spillage and dripping, medium overflow and medium drainage are all collected by the drip tray.

3. The beverage dispenser improvement of claim 1, in which the second conduit has an inside diameter smaller than a major outside diameter of the first conduit inlet, said second conduit being frictionally retained to the first conduit inlet.

4. The beverage dispenser improvement of either of claims 1, 2 or 3, in which the connection of the second conduit to the first conduit is at a level nearer to the level of the apex than to the level of the tank bottom.

* * * * *